US007815135B2

(12) United States Patent
Kato et al.

(10) Patent No.: US 7,815,135 B2
(45) Date of Patent: Oct. 19, 2010

(54) ICE SHAVING MACHINE

(75) Inventors: Yukio Kato, Mie (JP); Masakatsu Yamashita, Mie (JP)

(73) Assignees: Joytec Corporation, Kuwanashi (JP); Tyubu Corporation, Kuwanashi (JP)

( * ) Notice: Subject to any disclaimer, the term of this patent is extended or adjusted under 35 U.S.C. 154(b) by 535 days.

(21) Appl. No.: 11/795,555

(22) PCT Filed: Mar. 1, 2007

(86) PCT No.: PCT/JP2007/053888

§ 371 (c)(1),
(2), (4) Date: Jul. 18, 2007

(87) PCT Pub. No.: WO2008/004355

PCT Pub. Date: Jan. 10, 2008

(65) Prior Publication Data

US 2009/0282960 A1 Nov. 19, 2009

(30) Foreign Application Priority Data

Jul. 6, 2006 (JP) ..... 2006-186366
Aug. 18, 2006 (JP) ..... 2006-222866

(51) Int. Cl.
*B02C 19/00* (2006.01)

(52) U.S. Cl. ..... 241/65; 241/DIG. 17

(58) Field of Classification Search ..... 241/DIG. 17, 241/65, 84, 95, 248
See application file for complete search history.

(56) References Cited

U.S. PATENT DOCUMENTS

| | | | | | |
|---|---|---|---|---|---|
| 4,055,099 | A | * | 10/1977 | Mitsubayashi | 83/403 |
| 4,565,329 | A | * | 1/1986 | Himi | 241/95 |
| 4,745,773 | A | * | 5/1988 | Ando | 62/320 |
| 4,786,002 | A | * | 11/1988 | Mitsubayashi et al. | 241/101.8 |
| 4,919,075 | A | * | 4/1990 | Himi | 118/699 |

FOREIGN PATENT DOCUMENTS

| | | | |
|---|---|---|---|
| JP | 51-128462 | A | 11/1976 |
| JP | 62-296843 | A | 12/1987 |
| JP | 63-248349 | A | 10/1988 |
| JP | 01-155785 | U | 10/1989 |
| JP | 1-155785 | U | 10/1989 |
| JP | 2001-91292 | A | 7/2001 |
| JP | 2001-181292 | A | 7/2001 |

* cited by examiner

*Primary Examiner*—Faye Francis
(74) *Attorney, Agent, or Firm*—Birch, Stewart, Kolasch & Birch, LLP

(57) ABSTRACT

The present invention aims to provide an ice shaving machine that can produce a quantity of shaved ice powder without a fuss and that makes less noise. An ice shaving machine has an ice shaving chamber in which is provided a slit that a shaving blade faces, a rotary vane for rotating ice charged into the ice shaving chamber, a motor mechanism for rotating the rotary vane, a rotating hopper that stores the ice in the ice shaving chamber and coaxially rotates with the rotary vane, and an ice stocker that is provided above the rotating hopper and has openings at the lower and upper ends. The rotating hopper has a diameter that is reduced upwards, and the ice stocker coaxially rotates with the rotary vane and the rotating hopper.

14 Claims, 5 Drawing Sheets

【Fig. 3】
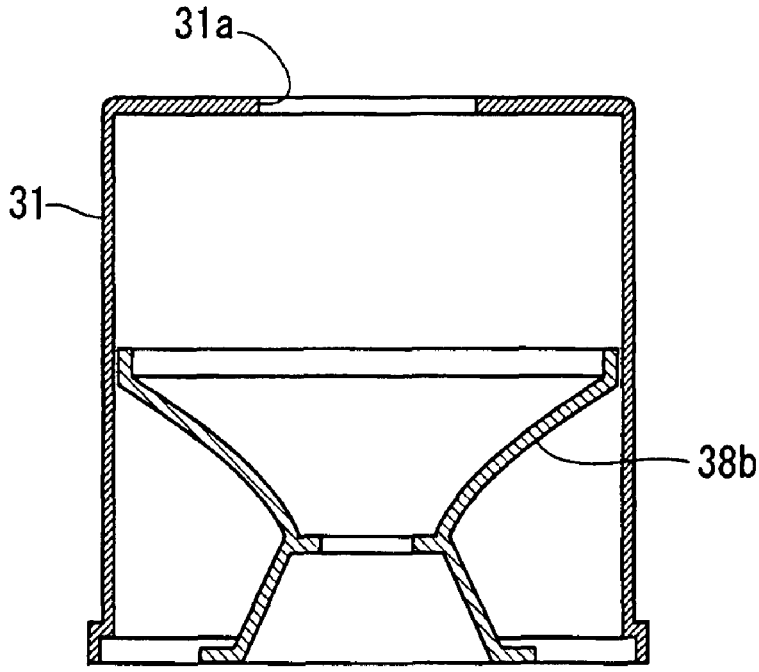
【Fig. 4】
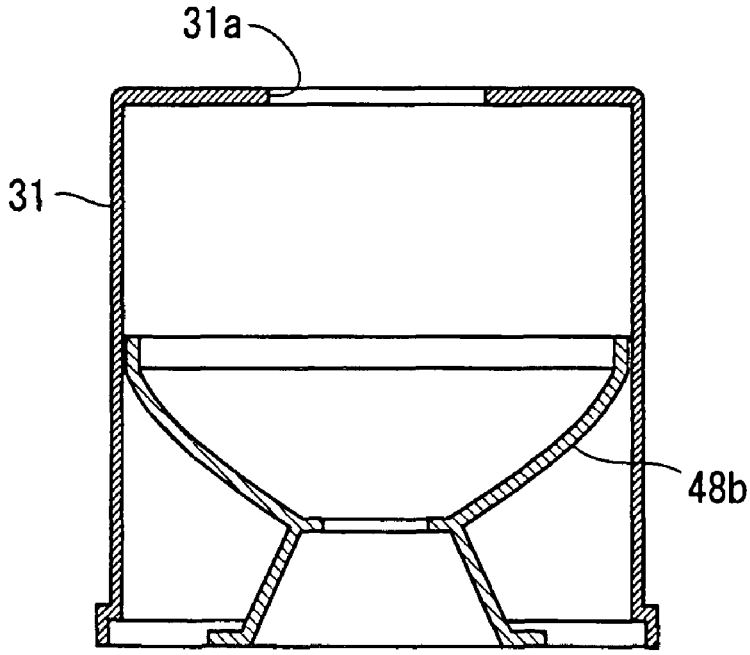

【Fig. 5】
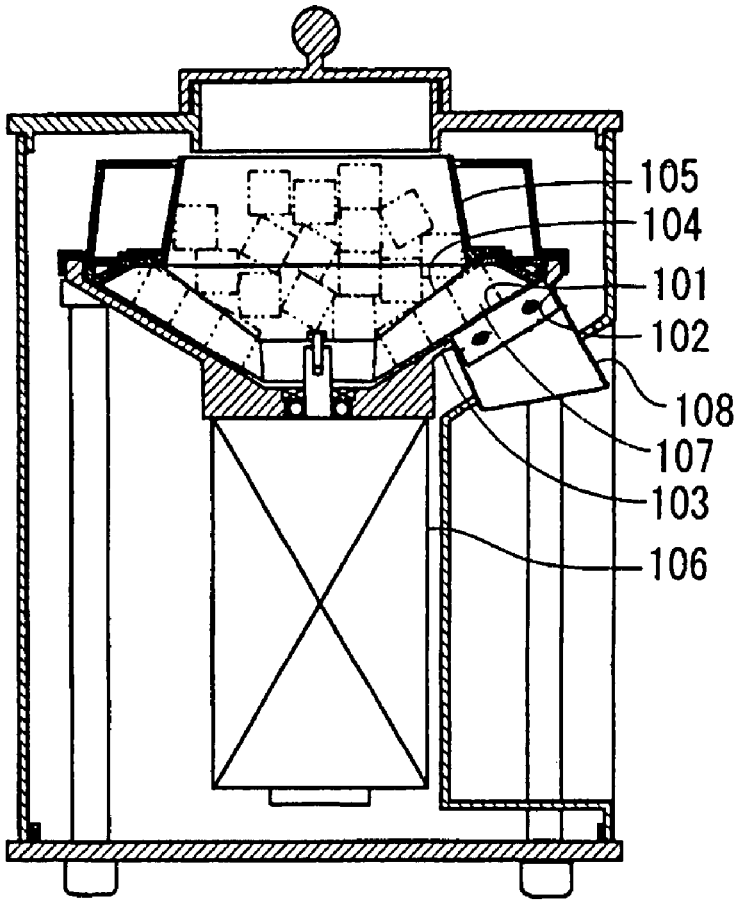

【Fig. 6】
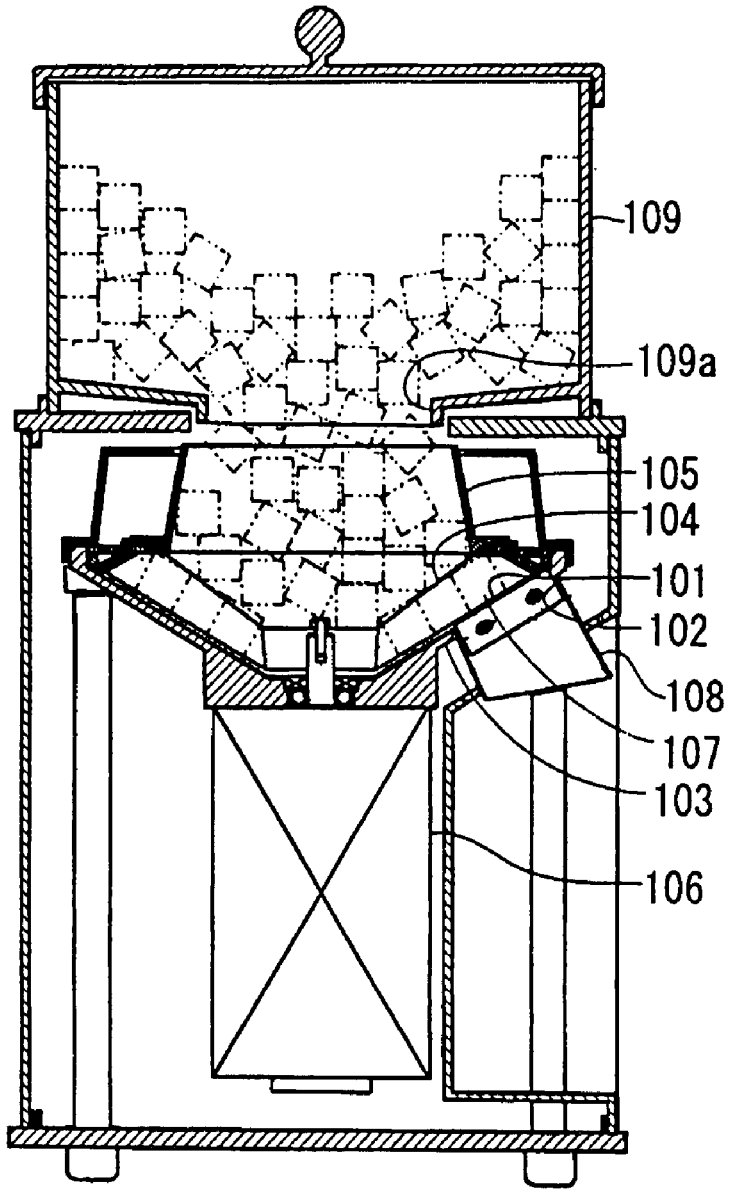

ICE SHAVING MACHINE

TECHNICAL FIELD

The present invention relates to a low-noise type ice shaving machine.

BACKGROUND ART

Conventionally, as shown in FIG. 5, as an ice shaving machine that makes shaved ice powder from a small block ice, the known ice shaving machine is provided with an ice shaving chamber 103 in which is provided a slit 102 that a shaving blade 101 faces, and a cylinder-like rotating hopper 105 that coaxially rotates with a rotary vane 104 (Patent Publication 1).

In the ice shaving machine, a motor mechanism 106 rotates the rotating hopper 105 together with the rotary vane 104, and cubic ice 107 charged into the rotating hopper 105 also rotates with the rotary vane 104 and the rotating hopper 105. This allows the ice 107 to be shaved while being pressed against a shaving blade 101 by centrifugal force, and shaved ice powder to be discharged from the ice outlet cover 108. As the rotating hopper 105 is shaped like a cylinder whose diameter is reduced upwards, ice rotating with the rotating hopper 105 is pressed against the inner wall of the rotating hopper 105 by centrifugal force, and thus subjected to downward force. Consequently, the ice in the rotating hopper 105 descends for the amount of the ice shaved by the shaving blade 101 and continue to be shaved by the shaving blade 101, which thus enables all ice charged into the rotating hopper 105 to be shaved completely.

However, in the ice shaving machine described above, whenever all the ice in the rotating hopper 105 has been shaved, rotation of the rotating hopper 105 must be stopped to supply ice, which is troublesome.

As shown in FIG. 6, as an ice shaving machine for solving such the problem, the ice shaving machine in which an ice stocker chamber 109 is provided above the rotating hopper 105 has also been known. According to this ice shaving machine, a large quantity of ice can be stored in the ice stocker 109. Then, to make up for the amount of ice shaved in the rotating hopper 105, ice is supplied into the rotating hopper 105 from an opening 109*a* provided on the bottom of the ice stocker 109. As this enables ice to be stored in the ice stoker 109, shaved ice powder can be made in quantity and without much fuss.

The ice shaving machine in Patent Publication 2 has also been known as technology related to the ice shaving machine of the present invention.

Patent Publication 1: Japanese Patent Application KOKAI Publication No. 62-296843

Patent Publication 2: Japanese Patent Application KOKAI Publication No. 63-248349

DISCLOSURE OF THE INVENTION

However, there is a problem with the conventional ice shaving machine with the ice stocker as described above because it makes a loud noise when producing shaved ice powder.

The present invention has been made to solve the conventional problem as described above, and aims to provide a low-noise ice shaving machine capable of making a large quantity of shaved ice powder without a fuss.

—First Invention—

The inventors studied the cause(s) of a loud noise generated by the conventional ice shaving machine with the ice stocker described above. As a result, the inventors found out that the noise is generated as the ice in the ice stocker collides against the ice the rotating hopper. In fact, in the conventional ice shaving machine with the ice stocker as shown in FIG. 6, while ice in the rotating hopper 105 rotates with the rotary vane 104 and rotating hopper 105, the ice in the ice stocker 109 is stationary. Therefore, when the ice is shaved, the stationary ice in the ice stocker 109 violently collide against the rotating ice in the rotating hopper 105, thus making a loud noise. As a result of our keen examination of a method for avoiding a collision among the ice, we realized that if the ice stocker coaxially rotated together with the rotating hopper, the collision among the ice could be avoided, and thus completed this first invention.

In fact, in the ice shaving machine of the first invention comprising an ice shaving chamber in which is provided a slit that a shaving blade faces, a rotary vane for rotating ice charged into the ice shaving chamber, a motor mechanism for rotating the rotary vane, a rotating hopper that stores the ice in the ice shaving chamber and coaxially rotates with the rotary vane, and an ice stocker that is provided above the rotating hopper and has openings at the lower and upper ends, the ice shaving machine is characterized in that diameter of the rotating hopper is reduced upwards and the ice stocker coaxially rotates together with the rotary vane and the rotating hopper.

In the ice shaving machine of the first invention, the motor mechanism rotates the rotating hopper together with the rotary vane. Then, ice in the rotating hopper rotates with the rotary vane and rotating hopper. This allows the ice to be shaved while being pressed against the shaving blade by centrifugal force, and shaved ice powder to be discharged from an ice outlet cover. As the rotating hopper has a diameter that is reduced upwards, ice rotating with the rotating hopper is pressed against the inner wall of the rotating hopper by centrifugal force, and thus subjected to downward force. Consequently, the ice in the rotating hopper descends for the amount of the ice shaved by the shaving blade, thus enabling all ice charged into the rotating hopper to be shaved completely.

In addition, the ice stocker is provided above the rotating hopper to store the ice. Yet, the ice stocker coaxially rotates with the rotary vane and rotating hopper, which prevents ice in the ice stocker and in the rotating hopper from grinding each other and making a loud noise. Furthermore, when all the ice in the rotating hopper has been shaved, ice stored in the ice stocker is automatically supplied into the rotating hopper from the opening at the lower end if the motor mechanism is deactivated to stop the rotation of the rotating hopper.

Therefore, according to the ice shaving machine of the first invention, shaved ice powder can be made in quantity without a fuss and noise can be reduced.

Preferably, the ice stocker is provided with a tapered section in which a diameter of the stocker is reduced toward the opening at the lower end. This allows ice in the ice stocker to slide off the oblique plane of the tapered section when the ice stocker is stopped, and ice is automatically supplied into the rotating hopper. In addition, as the diameter increases upwards, the amount of ice to be stored also increases.

Preferably, a diameter of the opening at the upper end of the ice stocker is two-thirds or smaller of the maximum inside diameter of the ice stocker. This is because there is a risk that ice stored in the ice stocker may jump out of the opening while rotating, if the diameter of the opening at the upper end of the ice stocker is greater than two-thirds of the maximum inside diameter of the ice stocker. This is especially preferable because when the tapered section is provided in which the diameter of the lower end of the ice stocker is reduced downwards, ice on the oblique plane of the tapered section is subjected to force in the ascending direction of the oblique plane of the tapered section by centrifugal force and pressure from the oblique plane of the tapered section, and ice tends to jump out of the opening at the upper end of the ice stocker. It is preferable to set an angle of the oblique plane of the tapered section to the horizontal plane to 30° to 60°. If the angle is less than 30°, ice does not slide off easily, while the amount of ice to be stored decreases if it exceeds 60°.

An inwardly protruding convex portion is preferably provided on the inner wall of the ice stocker. This allows the convex portion to prevent ice stored in the ice stocker from sliding when the ice stocker begins to rotate. Thus, generation of noise due to sliding ice can be suppressed, making the ice shaving machine less noisy.

It is preferable that the entire ice stocker or a part thereof be made of transparent material, which enables the amount of ice stored in the ice stocker to be visually checked from outside.

The periphery of the rotating hopper and/or the ice stocker is preferably enclosed by a noiseproof member, which can make the ice shaving machine less noisy.

It is also preferable that the ice shaving machine of the first invention be supported by a vibration-proofing member, which can reduce vibration while the ice shaving machine is driven. The vibration-proofing member is not limited and a coil spring, plate spring, rubber pad, etc., may be used. Although the effect of vibration control can be achieved if the vibration-proofing member is installed at any part of the upper, middle or lower end portions of the ice shaving machine, it is especially preferable if it is installed at the lowest end portion of the ice shaving machine as the effect of vibration control becomes remarkable. According to the test result of the inventors, the most effective vibration control can be achieved if a vibration-proofing member is installed at the lowest end portion of the shaving machine. In addition, it is more preferable to equally space the vibration-proofing member on the circumference drawn from the rotating axis.

—Second Invention—

In addition, the inventors further made efforts to study a method of avoiding possible collision between ice in the ice stocker 109 that is stationary and ice in the rotating hopper 105 that is rotating, when the conventional ice shaving machine provided with the ice stocker shaves ice. As a result, the inventors found out that in the rotating hopper, connection of a second tapered section whose diameter increases upwards to the upper end of the first tapered section whose dimension is reduced upwards could avoid a collision among ice, significantly reduce noise, and thus completed the second invention.

In fact, in the ice shaving machine of the second invention comprising an ice shaving chamber in which is provided a slit that a shaving blade faces, a rotary vane for rotating ice charged into the ice shaving chamber, a motor mechanism for rotating the rotary vane, a rotating hopper that stores the ice in the ice shaving chamber and coaxially rotates with the rotary vane, and an ice stocker that is provided above the rotating hopper and has openings at the lower and upper ends, the ice shaving machine is characterized in that:

the rotating hopper has a first tapered section whose diameter is reduced upwards, and a second tapered section that is connected to the upper end of the first tapered section and whose diameter increases upwards.

In the ice shaving machine of the second invention, the motor mechanism rotates the rotating hopper together with the rotary vane. Then, ice in the rotating hopper rotates with the rotary vane and rotating hopper. This allows ice to be shaved while being pressed against a shaving blade by centrifugal force and shaved ice powder to be discharged from the ice outlet cover.

In addition, as the first tapered section of the rotating hopper has the diameter that is reduced upwards, ice in the first tapered section is pressed against the inner surface of the first tapered section by centrifugal force and subjected to downward force. Consequently, the ice in the first tapered section descends for the amount of the ice shaved by the shaving blade and continues to be shaved in sequence.

On the one hand, as the second tapered section of the rotating hopper has the diameter that increases upwards, ice in the second tapered section is pressed against the inner surface of the second tapered section by centrifugal force, subjected to upward force, and ascends the inner surface of the second tapered section.

More specifically, when the rotating hopper is rotated, the ice in the first tapered section moves downward, while the ice in the second tapered section moves upwards. Thus, the ice is separated up and down so that interference can be avoided to prevent noise from being generated by collision among the ice. In addition, as the rotating hopper coaxially rotates with the rotary vane, the ice in the first tapered section and the ice in the second tapered section move along with the rotating hopper and do not collide violently with each other. Furthermore, a loud noise is not generated because the ice in the ice stocker rotates along with the rotation of the ice in the second tapered section while sliding on the inner surface of the ice stocker. Therefore, the ice shaving machine of the present invention is extremely low-noise.

In addition, since the ice stocker is provided above the rotating hopper, a large quantity of ice can be stored. In addition, even when all the ice in the rotating hopper has been shaved, the ice in the second tapered section loses centrifugal force, drops down, and is automatically charged into the first tapered section, if the motor mechanism is deactivated to stop the rotation of the rotating hopper. Furthermore, the ice stored in the ice stocker is automatically supplied into the second taper. Hence, according to the ice shaving machine of the present invention, a large quantity of shaved ice powder can be made without a fuss.

It is preferable to set an angle of the inner surface of the second tapered section to the horizontal plane to 15° to 45°. If the angle of the inner surface of the second tapered section to the horizontal surface is smaller than 15°, the ice in the second tapered section does not slide off easily and automatic supply of ice to the first tapered section may be impeded. On the other hand, if the angle of the inner surface of the second tapered section to the horizontal plane is greater than 45°, the height of the second tapered section must be made higher to enable storage of the predetermined amount of ice in the ice stocker, which leads to increased height of the ice shaving machine and a wider installation space.

It is also preferable to provide a small hole whose diameter is further squeezed, at a connection between the first and second tapered sections. Due to centrifugal force caused by rotation of the rotating hopper, the ice in the first and second tapered sections are separated up and down while being distributed in a doughnut shape. Then, if a small hole whose diameter is squeezed is provided at a connection between the first and second tapered sections, the diameter of the hole tends to be smaller than that of the doughnut of ice distributed in the doughnut shape, and interference between the ice in the first tapered section and the ice in the second tapered section is unlikely to occur, which thus makes less noise.

In addition, preferably, a diameter of the opening at the upper end of the ice stocker is two-thirds or smaller of the maximum inside diameter of the ice stocker. This is because there is a risk that ice stored in the ice stocker may jump out of the opening while rotating, if the diameter of the opening at the upper end of the ice stocker is greater than two-thirds of the maximum inside diameter of the ice stocker.

It is preferable that the entire ice stocker or a part thereof is made of transparent material, which enables the amount of ice stored in the ice stocker to be visually checked from outside.

The periphery of the rotating hopper and/or the ice stocker is preferably enclosed by a noiseproof member, which can make the ice shaving machine less noisy.

The ice shaving machines of the first and second inventions are provided with a receiving container for receiving shaved ice powder that is discharged from the slit. Thus, installed with a mixing mechanism that not only agitates any liquid into syrup, etc. contained in the receiving container but also microparticulates the shaved ice powder in the receiving container, the shaving machines can serve as an apparatus for producing iced soft drink that is a mixture of such a drink as juice and extremely fine ice. In this case, an agitating mechanism is preferably powered by a dielectric motor. This is because the dielectric motor generates less noise than a commutator motor.

In addition, in the ice shaving machines of the first and second inventions, it is also preferable that a safety shutdown mechanism be provided whereby the motor is not driven unless a receiving container for receiving shaved ice is set in the ice shaving machine. This can prevent the motor from being driven when no receiving container is set to keep the periphery of the ice shaving machine from being soaked with shaved ice powder. Such a safety shutdown mechanism can be configured so that a switch is pressed by a receiving container when the receiving container is set in the ice shaving machine, thereby preventing the motor from being driven unless the switch is pressed. In addition, if an agitating mechanism for agitating the drink in the receiving container is provided, a safety shutdown mechanism that prevents not only the motor of the ice shaving machine but also the agitating mechanism from being driven can be provided.

BRIEF DESCRIPTION OF THE DRAWINGS

FIG. 3 is a cross sectional view of a rotating hopper ad an ice stocker of an ice shaving machine of embodiment 3.

FIG. 4 is a cross sectional view of a rotating hopper and an ice stocker of an ice shaving machine of embodiment 4.

FIG. 5 is a cross sectional view of a conventional ice shaving machine using a rotating hopper.

FIG. 6 is a cross sectional view of a conventional ice shaving machine that uses a rotating hopper and is equipped with an ice stocker.

DESCRIPTION OF REFERENCE NUMERALS

Figure 1:
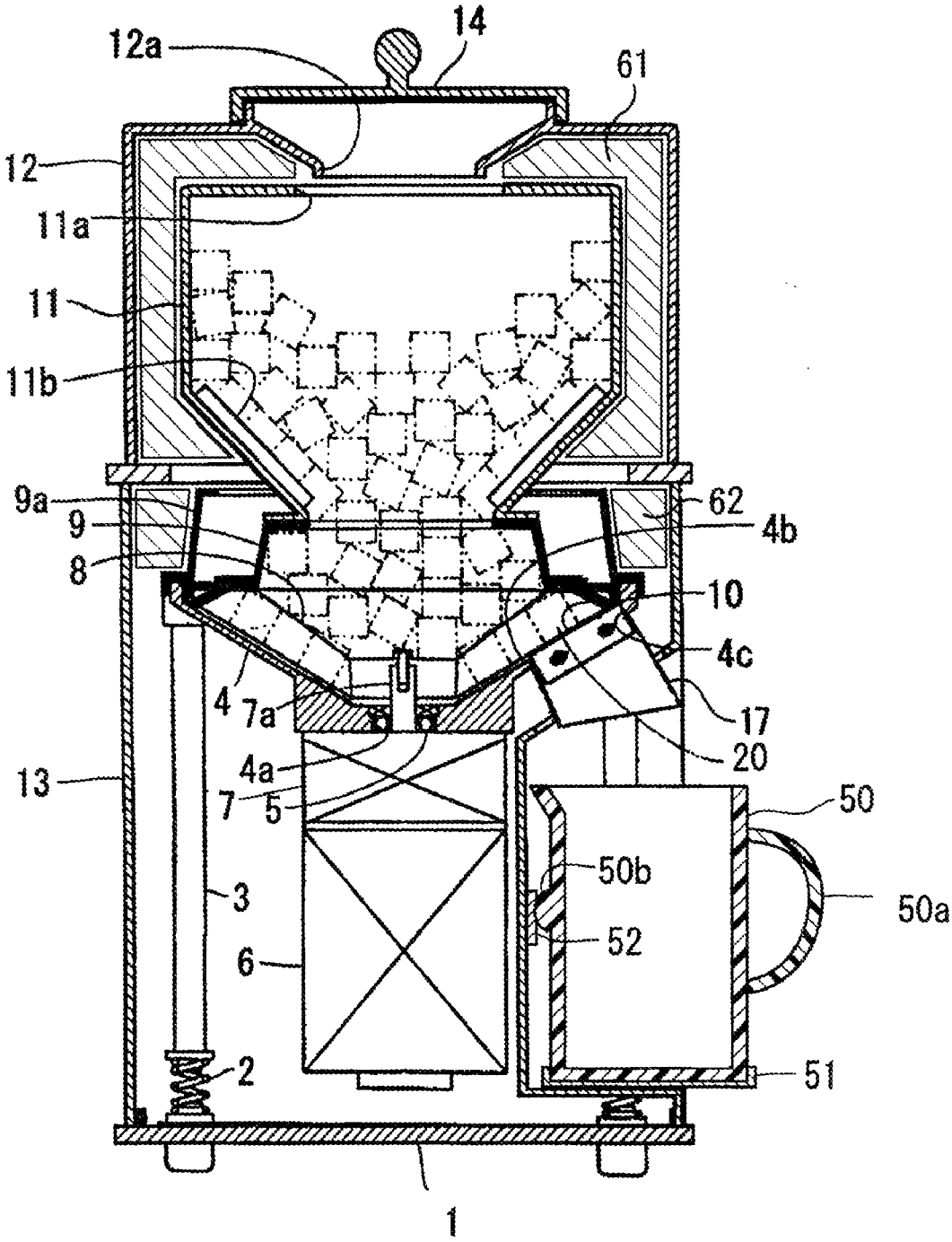
FIG. 1 is a cross sectional view of an ice shaving machine of embodiment 1.

10 Shaving blade
4*c* Slit
4 Ice shaving chamber
8 Rotary vane
6, 7 Motor mechanism (6 . . . motor, 7 . . . decelerator)
9 Rotating hopper
11 Ice stocker (Rotating ice stocker)
12*a* Opening
11*b* Convex portion
2 Vibration-proofing member (Spring)
39 Shaving blade
23*c* Slit
23 Ice shaving chamber
24 Rotary vane
25, 26 Motor mechanism (25 . . . motor, 26 . . . decelerator)
28 Rotating hopper
31 Ice stocker
31*a* Opening
28*a* First tapered section
28*b*, 38*b*, 48*b* Second tapered sections
28*c* Small hole

BEST MODE FOR CARRYING OUT THE INVENTION

In the following we describe in detail Embodiment 1 of the ice shaving machine of the first invention, with reference to the drawings.

Embodiment 1

The ice shaving machine of Embodiment 1 is designed to produce iced soft drinks, wherein, as shown in FIG. 1, springs 2 as vibration-proof members are provided at four corners of the square on a board 1, and struts are erected on the springs 2. To the upper ends of the struts 3 is fixed a mortar-shaped ice shaving chamber 4, at the bottom of which an opening 4*a* is provided into which a bearing 5 is fitted. Beneath the opening 4 are provided a motor 6 and a decelerator 7 of which a shaft 7*a* is fitted into the bearing 5. At the tip of the shaft 7*a*, a rotary vane 8 is attached along a tapered surface of the ice shaving chamber 4. To the upper end of the rotary vane 8 is fixed a cylinder-like rotating hopper 9 whose diameter is reduced upwards. A waterproof cover 9*a* is provided to the outside of the rotating hopper 9.

In addition, a slit 4*c* is opened in the direction of tilt of the tapered surface 4*b* of the ice shaving chamber 4, and a shaving blade 10 is screwed to the ice shaving chamber 4 so that a blade edge of the shaving blade 10 slightly protrudes to the interior of the ice shaving chamber 4. In addition, an ice outlet cover 17 is provided on the slit 4*c*, protruding perpendicular to the tapered surface 4*b*. Below the ice outlet cover 17, a receiving container 50 is mounted on the mount stand 51, and a convex portion 50*b* is provided on the opposite side to a handle 50*a* of the receiving container 50. A micro switch 52 is provided at the position facing the convex portion 50*b* and is arranged to be pressed by the convex portion 50*b* when the receiving container 50 is mounted on the mount stand 51. While the micro switch 52 is not pressed, supply of power to the motor 6 is stopped.

The upper end of the rotating hopper 9 is welded to the lower end of a cylinder-like rotating ice stocker 11 at the upper end of which an opening 11*a* is provided. A diameter of the opening 11*a* is one-half of the inside diameter of the rotating ice stocker 11. The lower part of the rotating ice stocker 11 is in tapered shape, its diameter being reduced downward, and on the tapered surface inwardly protruding convex portions 11*b* are provided, extending in the direction of tilt. An inclined angle of the tapered surface shall be 45° to the horizontal surface.

A shell is comprised of an upper external cover 12 and a lower external cover 13, and a taper-shaped slot 12*a* is provided at the center of the upper end of the upper external cover 12 and is covered by a slot lid 14.

In the following, we describe operation and effect of this ice shaving machine.

First of all, open the slot lid 14 and charge cubic ice till the rotating ice stocker 11 is filled. Then, close the slot lid 14, drive the motor 6, so that the rotary vane 8 rotates together with the rotating hopper 9. This allows the ice in the rotating hopper 9 to be shaved while being pressed against the shaving blade 10 by centrifugal force, and shaved ice powder to be discharged from the ice outlet cover 17. As the rotating hopper 9 has the diameter that is reduced upwards, the ice that rotates with the rotating hopper 9 is pressed against the inner wall of the rotating hopper 9 by centrifugal force 9 and subjected to downward force. Consequently, the ice in the rotating hopper 9 descends for the amount of the ice shaved by the shaving blade 10, and all of the ice charged into the rotating hopper 9 is shaved completely.

In addition, as the rotating ice stocker 11 rotates together with the rotating hopper 9, the ice in the rotating ice stocker 11 also rotates with the ice in the rotating hopper 9. This can prevent a collision between the ice in the rotating ice stocker 11 and the rotating hopper 9, thus making less noise. In addition, as the convex portions 11*b* prevents the ice in the rotating ice stocker 11 from sliding when rotation begins, there is almost no noise caused by grinding of ice against the inner surface of the rotating ice stocker 11. Furthermore, as the diameter of the opening 11*a* is narrowed to one-half of the inside diameter of the rotating ice stocker 11, the ice stored in the rotating ice stocker 11 does not jump out of the opening while rotating.

In addition, as the diameter of the lower part of the rotating ice stocker 11 is reduced downward, the ice in the rotating ice stocker 11 is subjected to centrifugal force and lifting force due to stress from the rotating ice stocker 11, and thus the ice in the rotating ice stocker 11 is not supplied into the rotating hopper 9 while rotating.

In addition, as the struts 3 that support the rotating hopper 9 and the rotating ice stocker 11 are supported by the springs 2 made of vibration-proof material, no violent vibration accompanies even while the motor 6 is being driven. Also, the springs 2 are attached to the lowest ends of the ice shaving machine and equally spaced on the circumference drawn from the rotating shaft, high vibration control effect can be achieved.

When the required amount of the shaved ice powder has been produced, deactivate the motor 6. This stops rotation of the rotating hopper 9 and the rotating ice stocker 11, and the ice in the rotating ice stocker 11 is supplied into the rotating hopper 9 by gravitational force. Therefore, by driving the motor 6 again, the ice in the rotating hopper 9 is shaved into ice powder again.

In addition, unless the receiving container 50 is placed on the mount stand 51, the micro switch 52 is not pressed, and supply of power to the motor 6 is stopped. This can prevent shaved ice powder from being splashed in the periphery of the ice shaving machine when the receiving container 50 is not placed on the mount stand 51.

As described above, according to the ice shaving machine of the embodiment, a large quantity of shaved ice powder can be produced without fuss and noise can also be reduced.

In addition, the rotating ice stocker 11 and the upper external cover 12 may be made of transparent plastic so as to enable internal observation. This can enable the stored amount of the ice in the rotating ice stocker 11 to be visually checked from outside, which is convenient.

It is also preferable that noiseproof members 61 and 62 are provided between the rotating ice stocker 11 and the upper external cover 12, and between the waterproof cover 9*a* and the lower external cover 13, respectively. This can further alleviate noise.

In addition, an apparatus for producing iced soft drink having the following technological characteristics can be provided below the ice outlet cover 17 of the ice shaving machine of the embodiment:

(1) An apparatus for producing iced soft drink, comprising a receiving container for receiving shaved ice powder that is discharged from the ice shaving machine, and an agitation mechanism for not only agitating the liquid into syrup and others contained in the receiving container but also microparticulating the shaved ice powder in the receiving container.

In this case, an agitating mechanism is preferably powered by a dielectric motor. This is because the dielectric motor generates less noise than a commutator motor.

In the following, we describe the specific embodiment 2 to embodiment 4 of the ice shaving machines of the second invention, with reference to the drawings:

Embodiment 2

Figure 2:
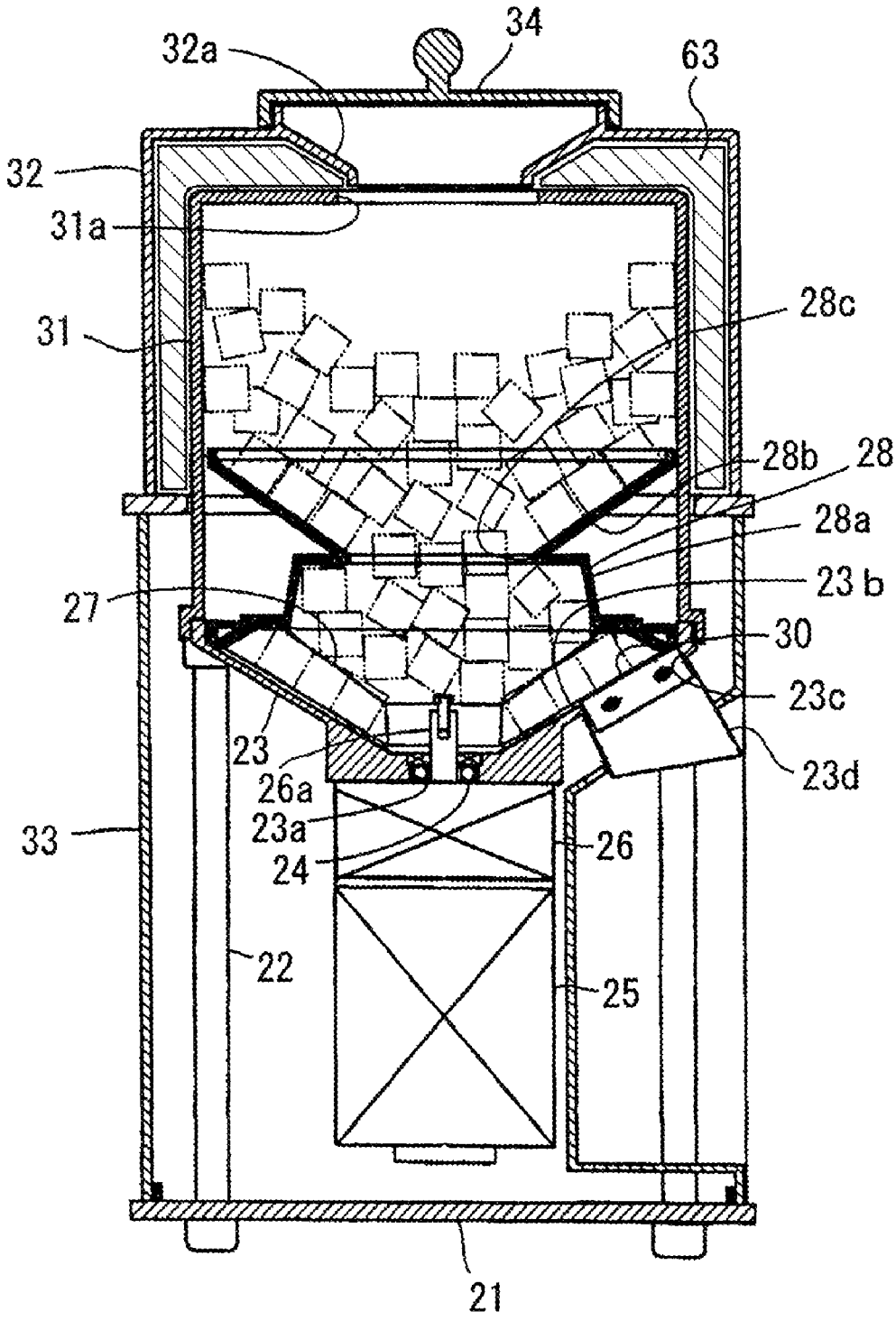
FIG. 2 is a cross sectional view of an ice shaving machine of embodiment 2.

The ice shaving machine of embodiment 2 is also designed to produce iced soft drinks, wherein, as shown in FIG. 2, struts 22 are erected on four corners of a square board 21 and a mortar shaped ice shaving chamber 23 is fixed to the upper ends of the struts 22. At the center of the bottom of the ice shaving chamber 23 is provided an opening 23*a* into which a bearing 24 is fitted. In addition, beneath the ice shaving chamber 23 are provided a motor 25 and a decelerator 26 of which a shaft 26*a* is fitted into the bearing 24.

At the tip of the shaft 26*a*, a rotary vane 27 is attached along a tapered surface 23*b* of the ice shaving chamber 23. To the upper end of the rotary vane 27 is fixed a rotating hopper 28 that can be rotated with the rotary vane 27.

The rotating hopper 28 is comprised of a first tapered section 28*a* whose diameter is reduced upwards and a second tapered section 28*b* that is connected to the upper end of the first tapered section 28*a* and whose diameter increases upwards. The inner surface of the second tapered section makes an angle of 30° to the horizontal surface. A small hole 28*c* whose diameter is squeezed is formed at the joint of the first tapered section 28*a* and the second tapered section 28*b*, and the upper end of the second tapered section 28*b* is open.

A cylinder-shaped ice stocker 31 is placed over the outer surface of the rotating hopper 28 with a slight clearance between the upper perimeter of the rotating hopper 28. At the upper end of the ice stocker 31 is provided an opening 31*a* whose diameter is made one-half of the inside diameter of the ice stocker 31.

A shell is comprised of an upper external cover 32 and a lower external cover 33, and a taper-shaped slot 32*a* is provided at the center of the upper end of the upper external cover 32 and is covered by a slot lid 34.

A slit 23*c* is opened in the direction of tilt of the tapered surface 23*b* of the ice shaving chamber 23, and a shaving blade 30 is screwed to the ice shaving chamber 23 so that it slightly protrudes to the interior of the ice shaving chamber 23. In addition, an ice outlet cover 23*d* is provided on the slit 23*c*, protruding perpendicular to the tapered surface 23*b*.

In the following, we describe operation and effect of this ice shaving machine.

First of all, open the slot lid 34 and charge cubic ice into ice stocker 31 for storage. Then, close the slot lid 34, drive the motor 25, and make the rotary vane 27 rotate together with the rotating hopper 28. This allows ice in the rotating hopper 28 to be shaved while being pressed against the shaving blade 30 by centrifugal force, and shaved ice powder to be discharged from the ice outlet cover 23*d*. As the first tapered section 28*a* of the rotating hopper 28 has the diameter that is reduced upwards, the ice that rotates with the first tapered section 28*a* is pressed against the inner wall of the first tapered section 23*b* by centrifugal force and subjected to downward force. Consequently, the ice in the first tapered section 28*b* descends for the amount of the ice shaved by the shaving blade 30, and all of the ice charged into the rotating hopper 28 is shaved completely.

On the one hand, as the second tapered section 28*b* of the rotating hopper 28 has a diameter that increases upwards, the ice in the second tapered section 28*b* is pressed against the inner surface of the second tapered section 28*b* by centrifugal force, subjected to upward force, and ascend on the slope of the second tapered section 28*b*.

In fact, when the rotating hopper 28 is rotated, ice in the first tapered section 28*a* moves downwards while ice in the second tapered section 28*b* moves upwards. Thus, as the ice in the first tapered section 28*a* and the second tapered section 28*b* are separated up and down, thereby avoiding interference therebetween. Moreover, as the rotating hopper 28 coaxially rotates with the rotary vane 27, the ice in the first tapered section 28*a* and the second tapered section 28*b* moves together with the rotating hopper 28*b*. This prevents the ice in the first and second tapered sections from colliding with each other, thereby reducing generation of noise. Furthermore, as the ice in the ice stocker 31 also rotates with the rotation of the ice in the second tapered section 28*b*, and moves together while sliding on the inner surface of the ice stocker 31, no large noise is generated.

Therefore, the ice shaving machine of the present invention is a low-noise type ice shaving machine.

In addition, since the ice stocker 31 is provided above the rotating hopper 28, a large quantity of ice can be stored. Also, when all the ice in the first tapered section has been shaved, the ice in the second tapered section loses centrifugal force, drops down, and is thus automatically supplied into the first tapered section 28*a* if the motor is deactivated to stop the rotation of the rotating hopper 28. Furthermore, the ice stored in the ice stocker 31 is automatically supplied into the second tapered section 28*b*.

Consequently, according to this ice shaving machine, a large quantity of shaved ice powder can be produced without a fuss, and noise can be reduced.

In addition, as the diameter of the opening 31*a* of the ice stocker 31 is made one-half of the inside diameter of the ice stocker 31, the ice stored in the ice stocker 31 tends not to jump out of the opening 31*a* during rotation.

Furthermore, as a hole 28*c* with a squeezed diameter is formed at the joint of the first tapered section 28*a* and the second tapered section 28*b*, the ice in the first tapered section 28*a* and the second tapered section 28*b* could be separated up and down, thus making it more difficult for noise to be generated even if the revolving speed of the rotating hopper 28 is slow and a diameter of a doughnut of ice distributed in the doughnut shape in the first tapered section 28*a* and the second tapered section 28*b* is small but greater than the diameter of the small hole 28*c*.

In addition, the ice stocker 31 and the upper external cover 32 may be made of transparent plastic so as to enable internal observation. This can enable the amount of ice stored in the ice stocker 31 to be visually checked from the external, which is convenient.

It is also preferable that a noiseproof member 63 is provided between the ice stocker 31 and the upper external cover 32. This can further alleviate noise.

Embodiment 3

As shown in FIG. 3, in the ice shaving machine of embodiment 3, the second tapered section 38*b* shall be radially-inwardly projecting. Other components are similar to those of the ice shaving machine of embodiment 1 as shown in FIG. 2. Thus, the same symbols are assigned to the same components and detailed explanation is omitted. Even such the ice shaving machine can achieve similar operation and effect to those of embodiment 1.

Embodiment 4

As shown in FIG. 4, in the ice shaving machine of embodiment 4, the second tapered section 48*b* shall be radially-outwardly projecting. Other components are similar to those of the ice shaving machine of embodiment 1 as shown in FIG. 2. Thus, the same symbols are assigned to the same components and detailed explanation is omitted. Even such the ice shaving machine can achieve similar operation and effect to those of embodiment 1.

The first tapered section may also be radially-inwardly or outwardly projecting, similar to the second tapered section in embodiment 2 or embodiment 3.

The present invention should not be limited to the description of the embodiments as described above. It may be a variety of variations and modifications without deviating from the description of the claims, and to the extent that one of ordinary skill in the art can easily conceive of.

INDUSTRIAL APPLICABILITY

The ice shaving machines of the first and second inventions may be used in producing shaved ice powder or iced soft drinks.

The invention claimed is:

1. An ice shaving machine comprising:

an ice shaving chamber in which is provided a slit that a shaving blade faces; a rotary vane for rotating ice charged into the ice shaving chamber;

a motor mechanism for rotating the rotary vane;

a rotating hopper that stores the ice in the ice shaving chamber and coaxially rotates with the rotary vane;

and an ice stocker that is provided above the rotating hopper and has openings at the lower and upper ends, wherein the rotating hopper has a diameter that is reduced upwards, the ice shaving machine, and the ice stocker coaxially rotates with the rotary vane and the rotating hopper.

2. The ice shaving machine according to claim 1, wherein the ice stocker is provided with a tapered section whose diameter is reduced toward the opening at the lower end.

3. The ice shaving machine according to claim 1 or 2, wherein a diameter of the opening at the upper end of the ice stocker is two-thirds or smaller of the maximum inside diameter of the ice stocker.

4. The ice shaving machine according to claim 1, wherein an inwardly-projected convex portion is provided on the inner wall of the ice stocker.

5. The ice shaving machine according to claim 1, wherein the entire ice stocker or a part of the ice stocker is made of a transparent member.

6. The ice shaving machine according to claim 1, wherein the periphery of the rotating hopper and/or the ice stocker is enclosed by a noiseproof member.

7. The ice shaving machine according to claim 1, wherein the ice shaving machine is supported by a vibration-proofing member.

8. The ice shaving machine according to claim 7, wherein the vibration-proofing member is installed at the lowest end.

9. An ice shaving machine, comprising:

an ice shaving chamber in which is provided a slit that a shaving blade faces;

a rotary vane for rotating ice charged into the ice shaving chamber;

a motor mechanism for rotating the rotary vane, a rotating hopper that stores the ice in the ice shaving chamber and coaxially rotates with the rotary vane;

and an ice stocker that is provided above the rotating hopper and has openings at the lower and upper ends, wherein the rotating hopper has a first tapered section whose diameter is reduced upwards and a second tapered section that is connected to the upper end of the first tapered section and has a diameter that increases upwards.

10. The ice shaving machine according to claim 9, wherein an angle of the inner surface of the second tapered section to the horizontal surface is 15° to 45°.

11. The ice shaving machine according to claim 9 or 10, wherein a hole is provided at the connection between the first tapered section and the second tapered section, and a diameter of the hole is smaller than the diameter of the first tapered section.

12. The ice shaving machine according to claim 9, wherein a diameter of an opening at the upper end of the ice stocker is made two-thirds or smaller of the maximum inside diameter of the ice stocker.

13. The ice shaving machine according to claim 9, wherein the entire ice stocker or a part thereof is made of a transparent member.

14. The ice shaving machine according to claim 9, wherein the periphery of the rotating hopper and/or ice stocker is enclosed by a noiseproof member.

* * * * *